US007604063B2

(12) United States Patent
Mashburn

(10) Patent No.: US 7,604,063 B2
(45) Date of Patent: Oct. 20, 2009

(54) FLOW VALVE AND METHOD

(76) Inventor: Benny Donald Mashburn, 103 Turn Row, Lafayette, LA (US) 70508

( * ) Notice: Subject to any disclaimer, the term of this patent is extended or adjusted under 35 U.S.C. 154(b) by 299 days.

(21) Appl. No.: 11/054,763

(22) Filed: Feb. 10, 2005

(65) Prior Publication Data

US 2006/0175092 A1 Aug. 10, 2006

(51) Int. Cl.
*E21B 34/08* (2006.01)

(52) U.S. Cl. ..... 166/386; 166/325; 175/318; 137/513.7; 137/539.5

(58) Field of Classification Search ..... 166/386, 166/320, 325; 137/539.5, 542, 543.19, 513.7; 175/318, 57

See application file for complete search history.

(56) References Cited

U.S. PATENT DOCUMENTS 2,214,290 A * 9/1940 Ward ..... 137/513.7
2,771,091 A * 11/1956 Baker et. al. ..... 137/542
3,957,114 A * 5/1976 Streich ..... 166/285
4,624,316 A * 11/1986 Baldridge et al. ..... 166/325
4,685,517 A * 8/1987 Baggett ..... 166/105
4,700,741 A * 10/1987 Murphy ..... 137/543.19
5,687,792 A * 11/1997 Rodger et al. ..... 166/327
6,152,171 A * 11/2000 Messick et al. ..... 137/543.13
7,171,972 B2 * 2/2007 Harrison ..... 134/22.18

FOREIGN PATENT DOCUMENTS

GB 2105012 A * 3/1983

* cited by examiner

*Primary Examiner*—Jennifer H Gay
*Assistant Examiner*—Robert E Fuller
(74) *Attorney, Agent, or Firm*—Jones Walker

(57) ABSTRACT

An apparatus for controlling the flow of a medium. The apparatus comprises a base having a plurality of arms extending from the base. The base and arms define a cage. A valve member is positioned within the cage. The apparatus further includes a biasing housing disposed within the base, and wherein a spring is disposed within the biasing housing. The apparatus further includes a passageway formed about the valve member when the valve member is opened so that the medium flows on the outer portion of the biasing housing, and wherein the flow of the medium in an opposite direction urges the ball into engagement with the valve seat. When the valve is open, the medium collapses the spring and the valve member blocks the flow of the medium from entering the biasing housing. A method of drilling a well with the flow valve positioned on a work string is also disclosed.

18 Claims, 6 Drawing Sheets

FLOW VALVE AND METHOD

BACKGROUND OF THE INVENTION

This invention relates to an inline valve. More particularly, but not by way of limitation, this invention relates to a flow valve used in the drilling of wells, and a method of using the flow valve.

In the search for oil and gas, operators drill wells many thousands of feet into the earth. The target of the drilling programs are subterranean reservoirs that contain hydrocarbons in liquid and gaseous states. A rotary drill bit is used to bore the hole. Different types of drilling bottom hole assemblies are available. For instance, a traditional tri-cone bit may be attached to a drill string, and wherein the drill string is rotated from the surface in order to rotate the bit. Another bottom hole assembly includes a drill motor placed upstream of the bit, and wherein the drill string remains stationary, but the drill motor causes the bit to turn thereby boring the well.

Generally, a drilling fluid is circulated within the bore hole. The drilling fluid has several purposes including but not limited to lubricating the bit, preventing hole sloughing, and containing the in-situ reservoir pressure. In some instances, the reservoirs are over pressured. Ideally, an operator would utilize a heavier drilling fluid which has the effect of increasing the hydrostatic pressure of the drilling fluid column which in turn controls the reservoir pressure from migrating into the well bore. However, in some cases, the in-situ reservoir pressure migrates out into the well bore in an event known as a kick. These kicks can be very dangerous since they can lead to blow outs. As readily understood by those of ordinary skill in the art, the migration of reservoir fluids, and in particular natural gas, causes the hydrostatic drilling fluid column to decrease in pressure, which in turn can lead to the blowout.

Numerous devices have been used to prevent blowouts. All these devices suffer from certain deficiencies in today's drilling environment. There is a need for a valve that controls flow of a medium from an oil and gas well. There is a need for a flow valve that can be used in conjunction with a drill string, with the flow valve being placed close to the bit. There is also a need for a device that will prevent and/or control the migration of the pressure into the drill string's inner diameter. There is also a need for a device that will prevent premature breakage of the valve spring during usage. In another embodiment, there is a need for a flow valve that can control the flow at the surface of a drilling rig. These and many other needs will be met by the invention herein disclosed.

SUMMARY OF THE INVENTION

An apparatus for controlling the flow of a medium is disclosed. The apparatus comprises a base having a plurality of arms extending from the base and a seat housing abutting the plurality of arms. In the preferred embodiment, the base and arms define a cage, and wherein the seat housing includes a valve seat. A valve member is positioned within the cage.

The apparatus further comprises a biasing means for biasing the valve member into engagement with the valve seat, and a biasing housing disposed within the base, and wherein the biasing means is disposed within the biasing housing.

The apparatus further includes a passageway formed about the valve member when the flow of the medium is from the surface through the apparatus in a first direction, and wherein the flow medium flows on the outer portion of the biasing housing. The flow of the medium in a second direction urges the ball into engagement with the valve seat. When the flow of the medium is in the first direction, the biasing means is collapsed so that flow of the medium proceeds through the apparatus, and in this position, the valve member blocks the flow of the medium from entering the biasing housing.

In the preferred embodiment, the valve member is a ball member. Also, the biasing means may be a spring and the apparatus further comprises a ball stop seat formed on the spring housing. The apparatus may further include a bleed off vent passage positioned within the seat housing for communicating a pressure upstream of the ball with a pressure downstream of the ball.

The apparatus may be located within a work sting within a well bore, and the medium may be a drilling fluid. In this embodiment, the work string is connected to a bit for boring the well bore. The apparatus may also be located in the Kelly of a drilling rig.

A method for drilling a well bore is also disclosed. The method includes providing a work string within the well bore, the work string having a bit, as well as providing a valve device within the work string. The valve device comprises: a base having arms extending from the base, a seat housing abutting the arms; a valve member positioned within the base; a biasing member for biasing the valve member into engagement with a valve seat; a biasing housing disposed within the base, with the biasing means disposed within the biasing housing; wherein the flow of the medium in a first direction biases the biasing member so that flow of the medium proceeds through the valve device, and the flow of the medium in a second direction urges the valve member into engagement with the valve seat. The method further includes flowing the medium in the first direction through the work string and unseating the valve member from the valve seat so that a passageway is formed about the valve member when the flow of the medium is in the first direction. Next, the method includes directing the medium about the biasing housing and drilling the well bore with the bit.

The method may further include drilling through a subterranean reservoir containing hydrocarbons. A gas may migrates from the reservoir into the well bore, and the gas flows in the second direction. The valve member moves in the second direction with the biasing member and the valve member engages with the valve seat. The drilling can then be terminated. In the most preferred embodiment, the biasing means is a spring.

The method may further include pumping a weighted fluid into an internal portion of the work string, compressing the spring, and disengaging the valve member with the valve seat. A weighted fluid can be pumped through the bit and into the well bore which in turn controls the migration of the gas into the well bore. The method would then include resuming the drilling with the bit.

An advantage of the present invention includes use of a blow out preventor that is placed down hole near the bit. Another advantage is the invention can be used with traditional drill strings that are rotated from the rotary on the drill floor. Yet another advantage is that the invention can also be used with measurement while drilling electronic devices. Still yet another advantage is that the invention can be used with down hole mud motors that rotate the drill bit while the drill string remains static.

A feature of the invention is that coiled springs may be used as the biasing means. Another feature is that flow of the medium through the spring and the spring housing is prevented which in turn reduces cycling of the spring, which is sometimes referred to as chatter. Still yet another feature is that a flow path is created around the valve element. Yet another feature is that the flow path thus created allows a maximum flow area thereby reducing pressure drops through the valve during pumping. Another feature is that the flow valve can be used in conjunction with the Kelly on the rig for controlling pressure during drilling operations.

DETAILED DESCRIPTION OF THE PREFERRED EMBODIMENTS

Figure 1:
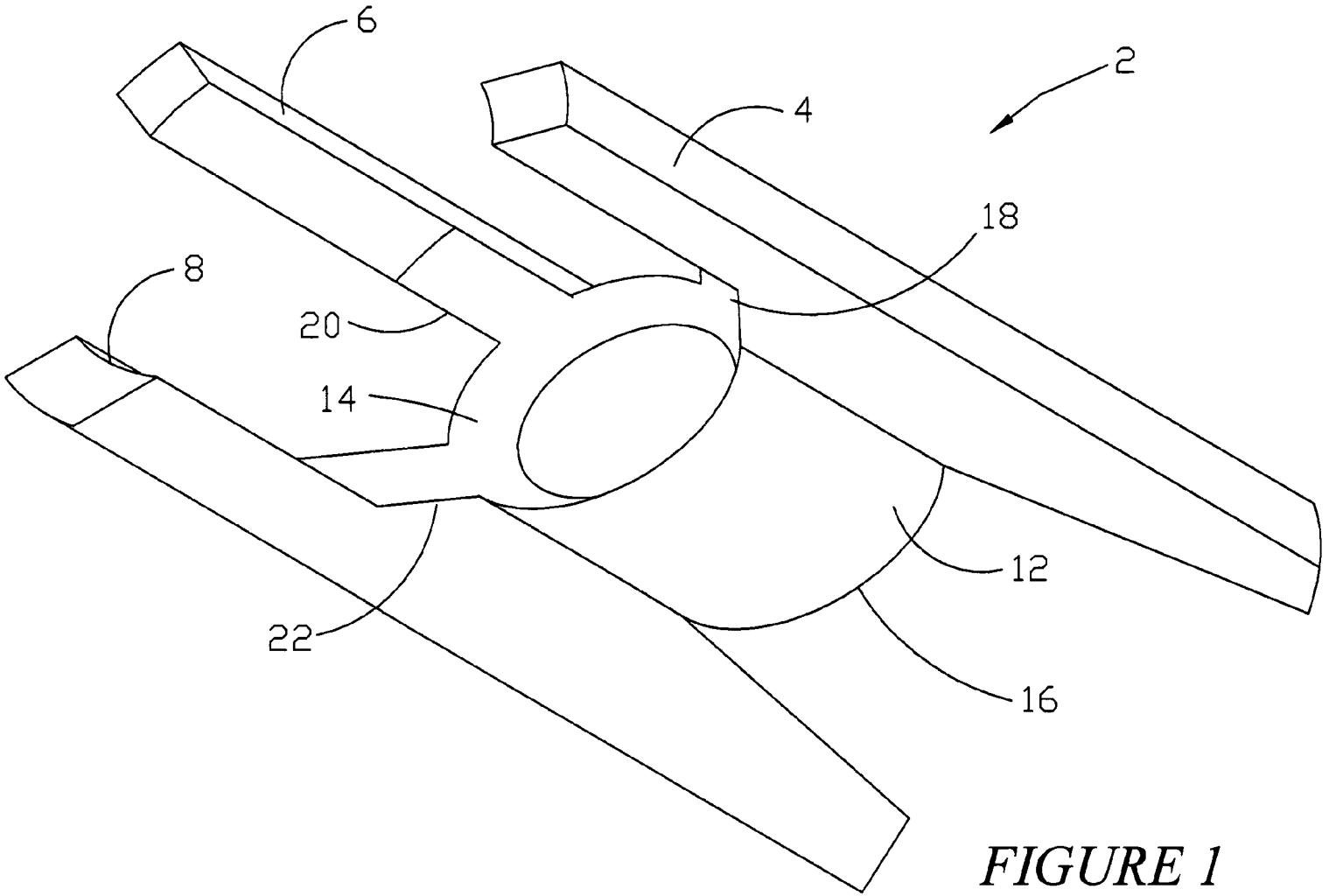
FIG. 1 is an isometric view of the base of the present flow valve.

Referring now to FIG. 1, an isometric view of the base 2 of the present down hole valve will now be described. Please note that the base 2 is also sometimes referred to as the pedestal 2. The base 2 includes a first leg 4, second leg 6, and third leg 8 that extend from a cylindrical member 12. The cylindrical member 12 is also referred to as the biasing housing 12. The biasing housing 12 has a first end 14 and a second end 16, and wherein the first end 14 is also referred to as ball stop 14 as will be more fully explained later in the application. The leg 4 is connected to the cylindrical member 12 with the connector portion 18, the leg 6 is connected to the cylindrical member 12 with the connector portion 20, the leg 8 is connected to the cylindrical member 12 with the connector portion 22.

Figure 2:
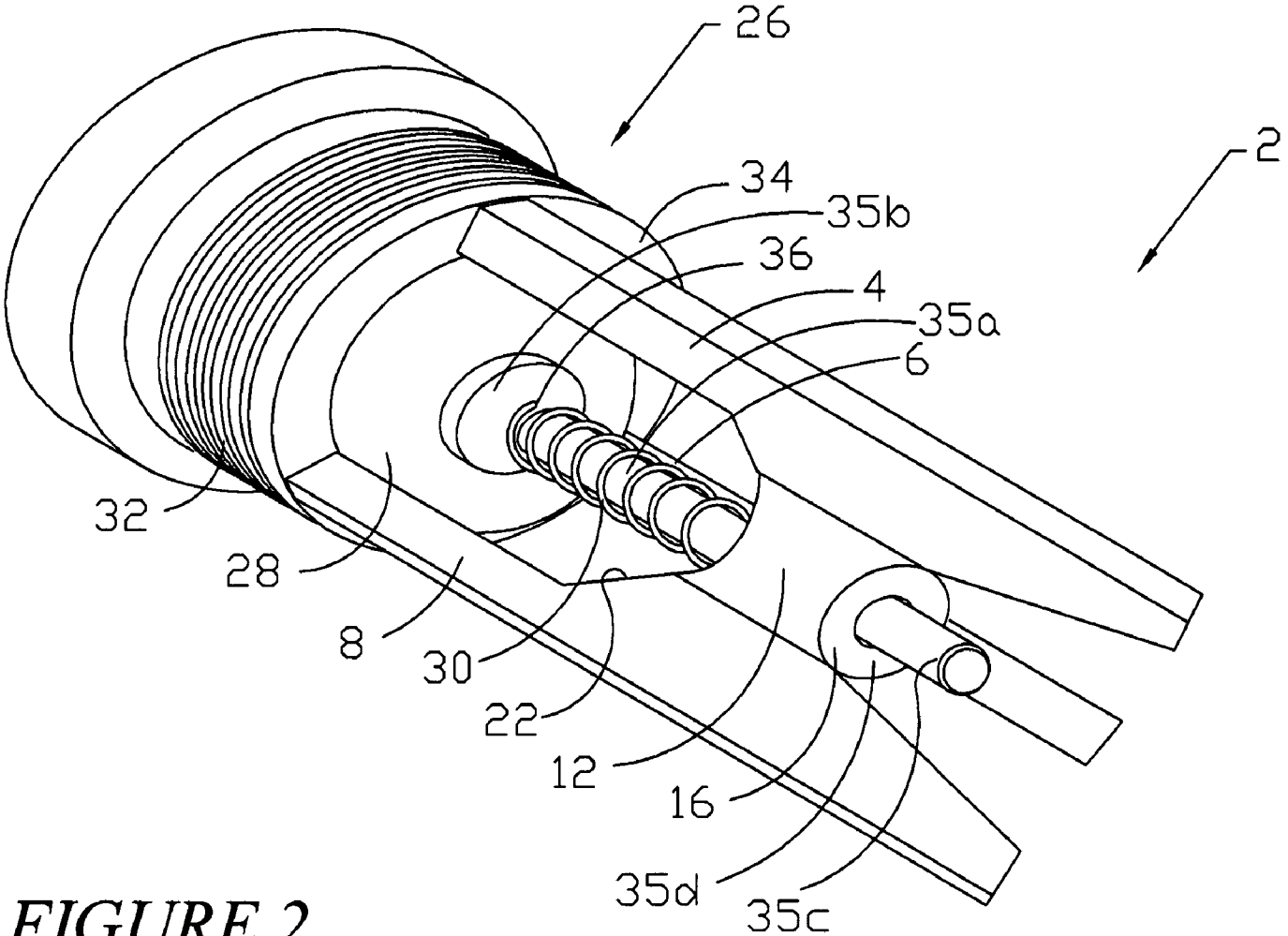
FIG. 2 is an isometric view of the base, seat housing, valve member and biasing member of the present flow valve.

FIG. 2, which is an isometric view of the base 2, seat housing 26, valve member 28 and biasing member 30 of the present down hole valve, will now be described. It should be noted that like numbers appearing in the various figures refer to like components. The seat housing 26 is generally a cylindrical member with an outer portion having external thread means 32, with the external thread means 32 extending to the end 34. The legs 4, 6, 8 are attached to the end 34 via conventional means such as welding, even though the legs could have been attached via nuts and bolts; also, the legs could have been formed integrally thereon. The legs 4, 6, 8 and seat housing 26 define a cage for placement of the valve member 28.

Although not shown in FIG. 2, the seat housing 26 has a valve face that will engage with the valve member 28. In the preferred embodiment, the valve member 28 is a spherical ball member 28. The spherical face of the ball member 28 will engage and come into contact with the valve face of the valve member 28. In one preferred embodiment, the valve face is configured to receive and sealingly engage the spherical ball member 28.

FIG. 2 further depicts the biasing member 30. More specifically in one preferred embodiment, the biasing member 30 is a coiled spring 30. A spring guide 35*a* is disposed within the coiled spring 30. The spring guide 35*a* has a first end that contains a cradle 35*b* that engages the ball member 28. The cradle 35*b* is generally in a concave shape that engages the ball member 28. The spring guide 35*a* has a second end 35*c* that is slidably disposed in opening 35*d*.

Figure 3:
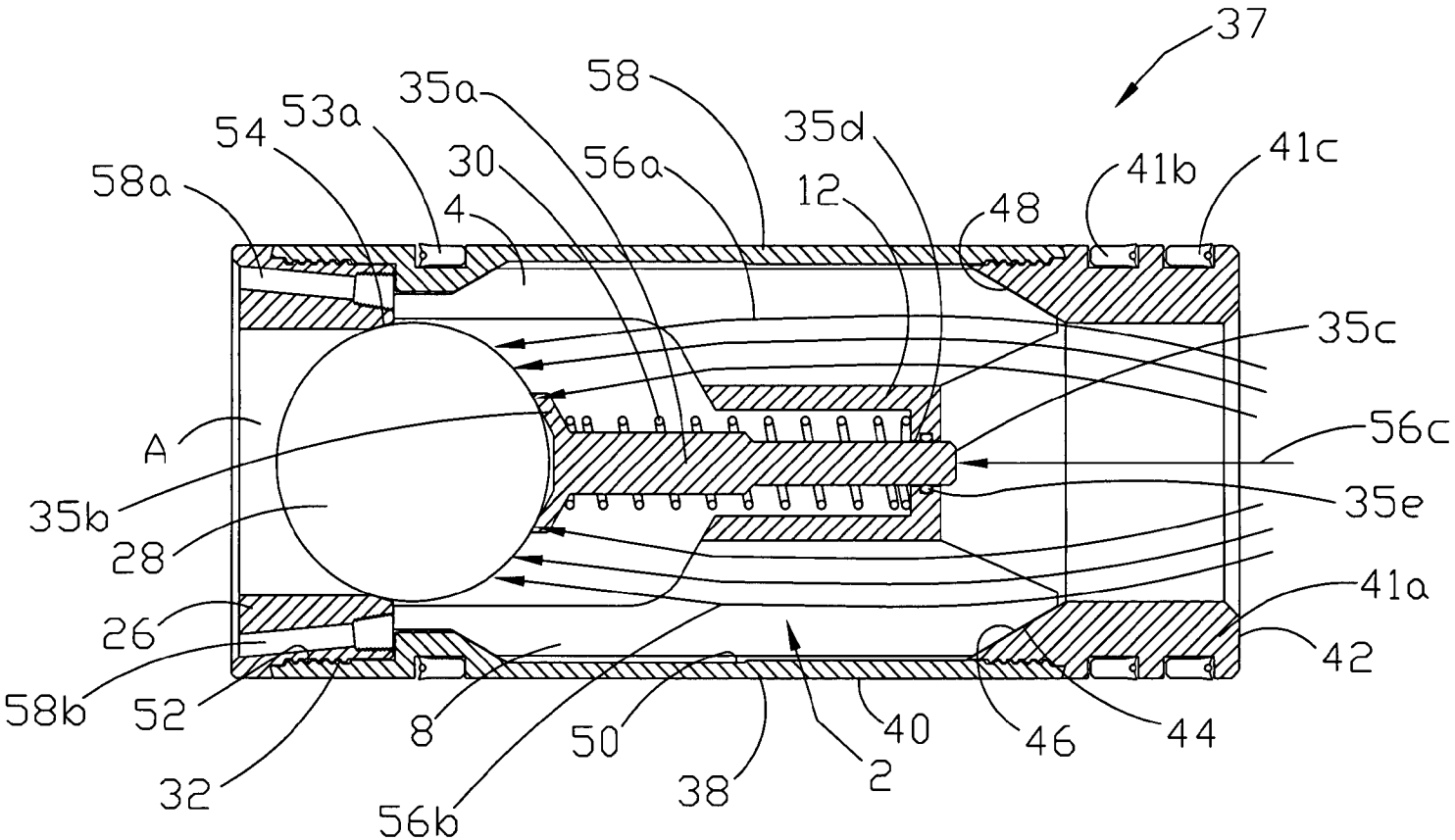
FIG. 3 is a cross-sectional view of the flow valve of the present invention.

Referring now to FIG. 3, a cross-sectional view of the flow valve 37 of the present invention will now be described. The spring guide 35*a* and spring 30 are partially disposed within the biasing housing 12. Seal means, such as o-ring 35*e*, may also be included. The coiled spring 30 has a first end 36 abutting the cradle 35*b* of the spring guide 35*a*, as shown in FIG. 2.

As shown in FIG. 3, the spring guide 35*a* prevents the coiled spring 30 from buckling during use and generally keeps the coiled spring 30 aligned properly within the valve 37, and in particular, within biasing housing 12. A second end of the coiled spring 30 abuts the first end 14 of the biasing housing, and wherein the first end 14 is sometimes referred to as the ball stop 14 (the ball stop 14 is seen in FIG. 1). The valve member 28 is normally closed due to the biasing member 30 urging the valve member 28 into engagement with the valve face.

Figure 4:
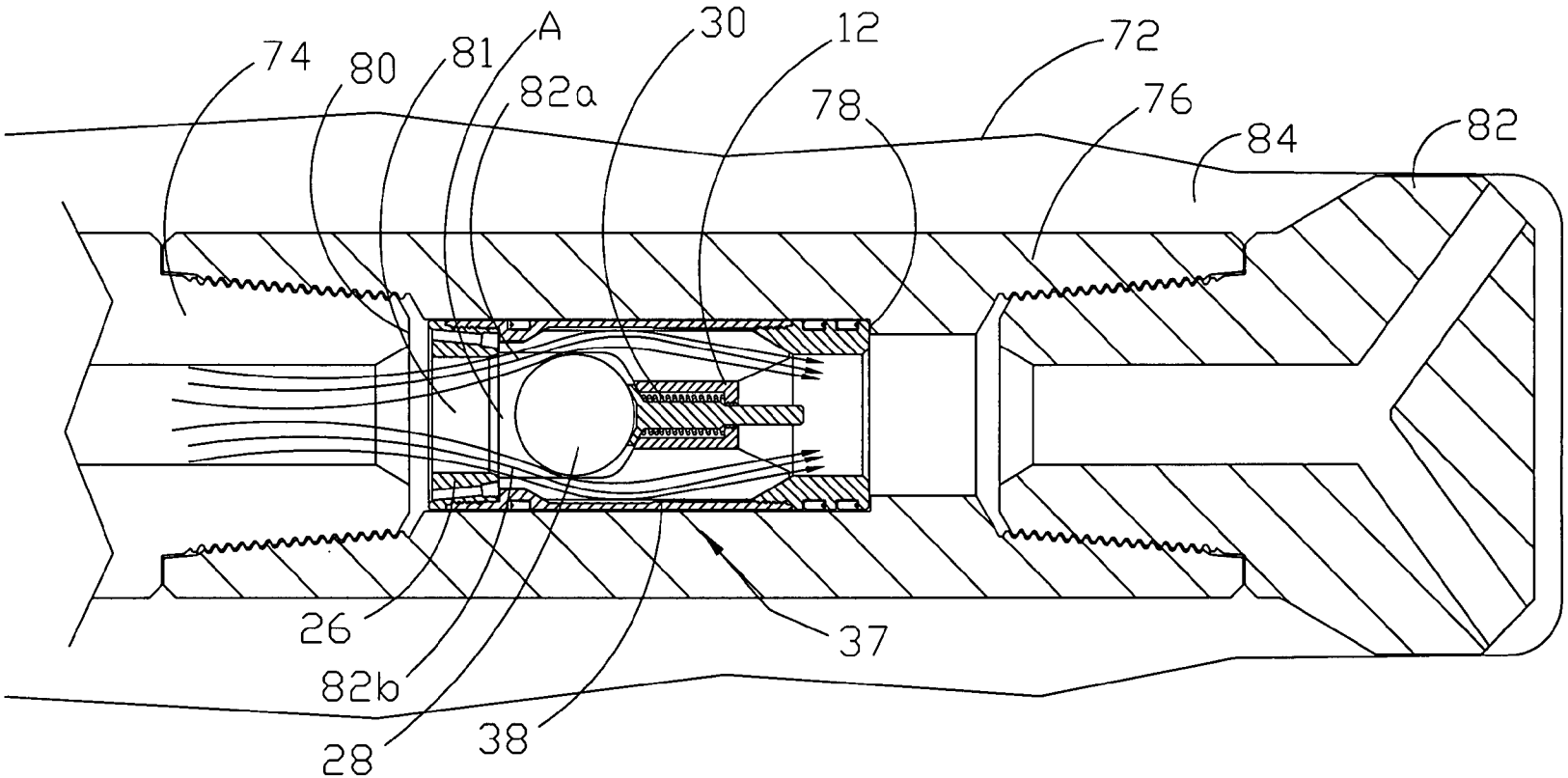
FIG. 4 is a partial cross-sectional view of the flow valve seen in FIG. 3 situated within a drill string embodiment in a well bore, with the valve in the open position.

The flow valve 37 includes the base 2, the biasing housing 12, the seat housing 26 and the valve member 28, which are encased in an outer housing 38. The outer housing 38 is generally cylindrical with an outer surface 40 that extends to the end sub 41*a*. The outer housing 38 is threadedly connected to the end sub 41*a*. End sub 41*a* has end 42 which in turn extends radially inward to the chamfered shoulder 44. An end 46 of leg 8 and an end 48 of leg 4 abut the chamfered shoulder 44. The end sub 41*a* has a pair of o-rings, 41*b*, 41*c*, that will seal pressure when the flow valve 37 is disposed within an outer member, such as seen in FIG. 4.

Returning to FIG. 3, the outer housing 38 has an inner portion 50 and wherein inner portion 50 extends to the inner thread means 52, and wherein inner thread means 52 will cooperate and engage with the external thread means 32 of the seat housing 26. The outer housing also contains o-ring seals 53*a* for sealing with an outer member. Hence, in one preferred embodiment, once the base 2, biasing housing 12, seat housing 26, and valve member 28 are placed within the outer housing 38 and the outer housing 38 is connected to the seat housing 26 and the end sub 41*a*, the flow valve 37 can be placed into a work string, as will be more fully explained later in the application.

As shown in FIG. 3, the seat housing includes a valve face 54. As noted earlier, the valve member 28 is biased into engagement with valve face 54 via spring 30. Additionally, in the orientation shown in FIG. 3, the flow valve 37 is in the position associated with an influx of gas into the work string i.e. a kick. The flow arrow 56*a* depicts the upward flow on one side of the biasing housing 12, the flow arrow 56*b* depicts the upward flow on the other side of the biasing housing 12, and the flow arrow 56*c* depicts the upward flow acting against the end 35*c*. It should be noted that seal means, such as o-ring 35*d*, can be included.

The valve face 54 is configured to receive and engage with the ball member's 28 spherical contour. The flow valve 37, in the preferred embodiment, is configured to be a normally closed valve. In other words, the spring 30 normally biases the ball 28 into engagement with the valve face 54 when there is no flow down the work string. If the operator begins pumping a medium, such as a drilling fluid, down the work string, the pumping will cause the spring 30 to compress thereby opening the passageway. However, in the case where a kick is experienced, such as seen in FIG. 3, the flow from the subterranean reservoir (represented by flow arrows 56*a*, 56*b*, 56*c*) and the spring 30 will close the down hole valve 37.

Also included with the flow valve 37 is the bleed off vents 58*a*, 58*b*. The bleed off vents 58*a*, 58*b* allow pressure that may have built up below the valve member 28 to equalize with the area above the valve member 28. Hence, in the case of a kick, the valve 37 will be in the closed position seen in FIG. 3, and with the bleed off vents 58*a*, 58*b*, the pressure can be bleed off to the area above the ball 28, with the area being denoted by the letter "A". It should be noted that in cases where an operator does not wish to bleed off vents 58*a*, 58*b*, a set screw (not shown) can be threadedly made up with the bleed off vent 58 so that the vent is closed and pressure can not pass through the vent to the area "A".

Referring now to FIG. 4, a partial cross-sectional view of the flow valve 37 seen in FIG. 3 is situated within a bottom hole assembly attached to a drill string (drill string not seen in this view). The drill string is positioned within a well bore 72, with the valve 37 in the open position which corresponds to the operator pumping a drilling fluid down the inner portion of the drill string. In this embodiment, the drill string is attached to a bottom hole assembly that includes a measurement while drilling tool (MWD tool) 74 which can measure and calculate certain electrical and nuclear properties of the drilled subterranean formation such as resistivity and gamma ray values, as is readily understood by those of ordinary skill in the art.

A bit sub 76 is threadedly made up to the MWD tool 74. The bit sub 76 has a radial shoulder 78 formed on the inner portion thereof, and wherein the down hole valve 37 is configured to abut the radial shoulder. Additionally, the MWD tool 74 has its end 80 cooperate with the upper portion of the seat housing 26 so that the valve 37 is secured in place within the bottom hole assembly seen in FIG. 4. The bit sub 76 is connected to the bit 82 In FIG. 4, the bottom hole assembly consist of the bit 82, bit sub 76 and MWD tool 74.

In operation, a medium is pumped down the inner portion of the drill string. The medium in the preferred embodiment is a drilling fluid, although the medium could be air, salt water, etc. As noted earlier, the drilling of the well bore 72 is caused by the rotation of the bit. As the medium travels through the inlet port 81 and area A of the seat housing 26, this will cause the spring 30 to collapse (i.e. compress), as mentioned earlier. Note that a passageway is formed about the valve member 28, with the flow arrows 82*a*, 82*b* representing the medium through the passageway and legs of the base 2. The medium exits the bit 82 and the medium then travels up the annulus area 84.

Figure 5:
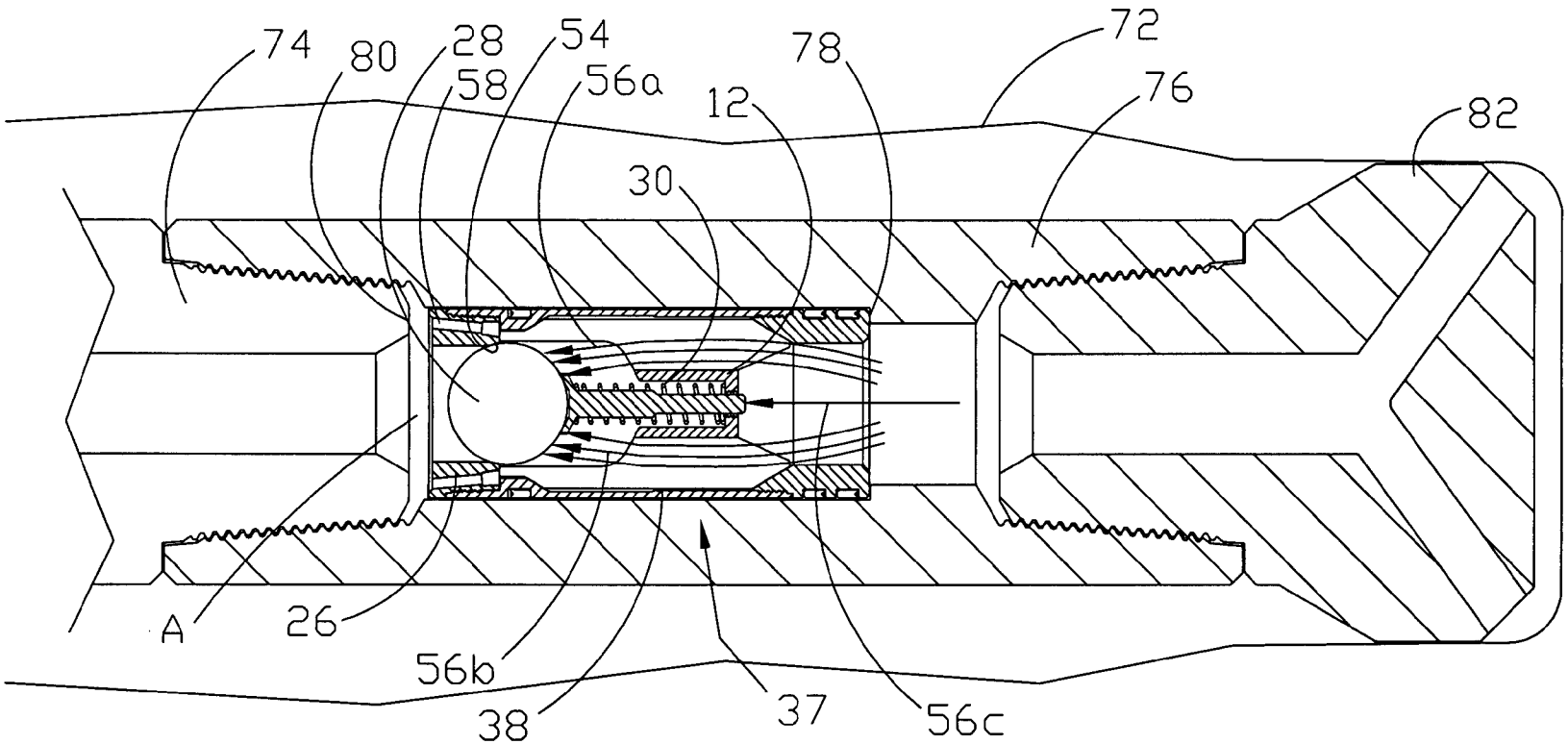
FIG. 5 is the partial cross-sectional view of the flow valve seen in FIG. 4, with the valve in the closed position.

FIG. 5 is a partial cross-sectional view of the flow valve 37 seen in FIG. 4, with the valve 37 having been moved to the closed position. The position seen in FIG. 5 corresponds to the situation wherein the well bore 72 has experienced a kick or if there is no flow, and therefore, valve 37 is in its normally closed position. As noted earlier, the flow allows the spring 30 to extend the ball 28 into engagement with the valve face 54, with the arrows 56*a*, 56*b*, 56*c* representing the flow path of the medium urging the ball 28 to the closed position. The internal portion of the drill string is closed and therefore the increase of pressure within the drill string will be controlled. In the case where the vents 58*a*, 58*b* have been included, the vents 58*a*, 58*b* will allow a controlled equalization of pressure into the internal portion of the drill string in area "A" and internal portion of the drill string.

Figure 6:
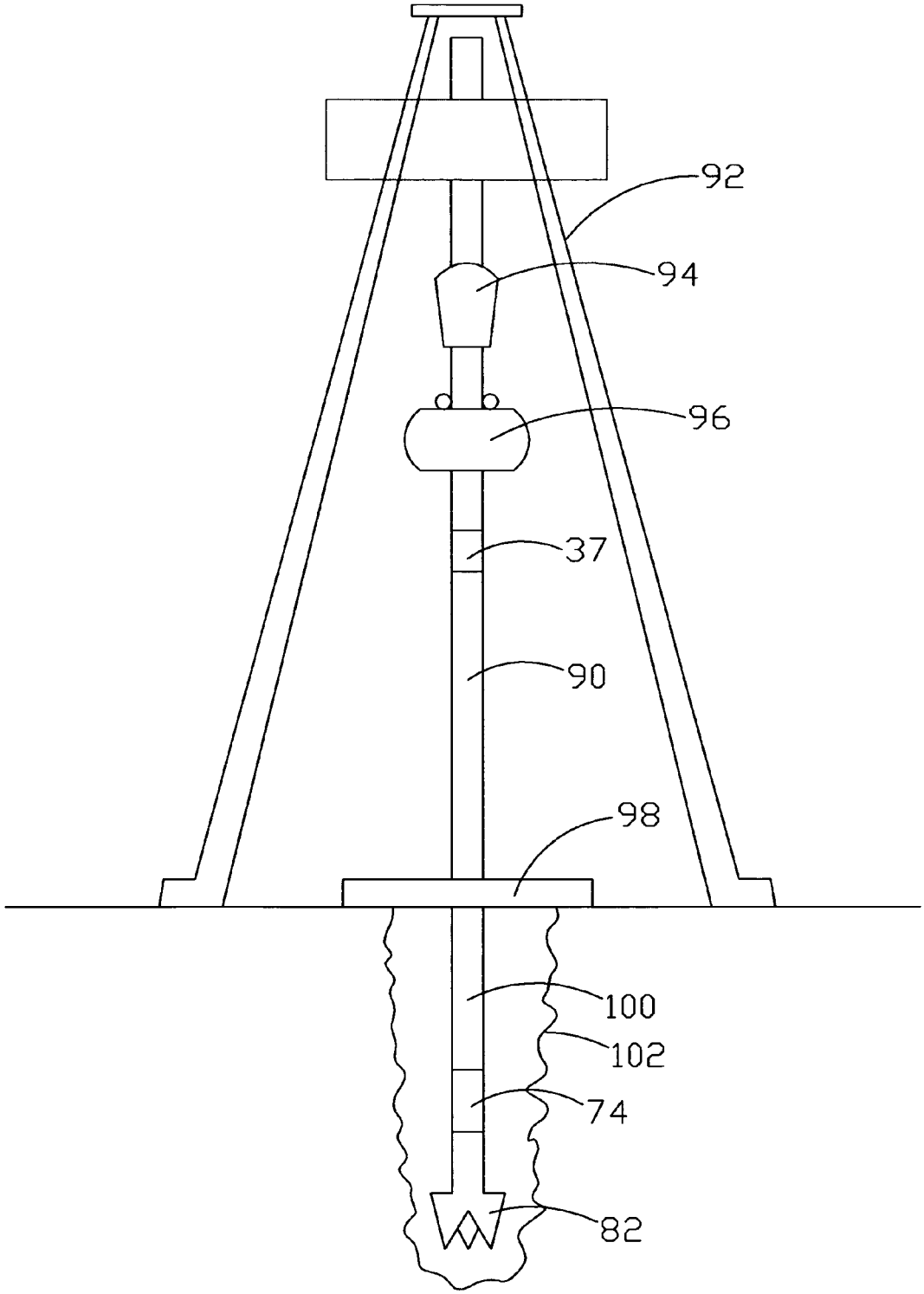
FIG. 6 is a schematic of a second embodiment of the flow valve seen in FIG. 3 operatively associated with a Kelly on a drilling rig.

FIG. 6 is a schematic of a second embodiment of the flow valve 37 seen in FIG. 3. In this embodiment, the flow valve 37 is situated in line with a Kelly 90. FIG. 6 depicts a drilling rig 92 with a block 94 that is operatively associated with the drawworks, as understood by those of ordinary skill in the art. A swivel 96 is suspended from elevators 98, and wherein the Kelly 90 is attached to the swivel 96. The Kelly 90 will be attached to the rotary bushing 98, and wherein a rotary table will rotate the bushing 98 and Kelly 90. The flow valve 37 is seen connected in-line with the Kelly 90. A work string, such as a drilling string 100, extends into a well bore 102. The drill string 100 may have the bit 82 and MWD 74 operatively attached.

Flow down the work string 100 is possible, and if the well bore 102 experiences a kick, the flow valve 37 will be urged closed in the manner previously described, thereby containing the high pressure liquids and gas within the Kelly. In order to kill the well, a weighted kill fluid can be pumped through the flow valve 37 into the well bore 102. In this manner, the flow valve operates as a one-way check valve. Thus, according to the teachings of present invention, the flow valve 37 can be operated at the surface as well as down hole in conjunction with a bottom hole assembly.

Changes and modifications in the specifically described embodiments can be carried out without departing from the scope of the invention which is intended to be limited only by the scope of the appended claims and any equivalents thereof.

I claim:

1. A valve apparatus for controlling the flow of a medium in a hydrocarbon well bore comprising:

a pedestal;

a plurality of arms extending from the pedestal;

a seat housing abutting said plurality of arms, wherein said scat housing and said plurality of arms defines a cage, and wherein said seat housing includes a valve seat and wherein a flow path is defined thru said arms;

a ball member positioned within said cage and wherein said ball member is moveable within said cage;

a biasing means for biasing said ball member into a sealing engagement with said valve seat;

a biasing housing operatively associated with said biasing means;

wherein when said valve a apparatus is in an opened position the flow of a drilling fluid in a first direction retracts the biasing means so that flow of said drilling fluid proceeds through apparatus said valve apparatus with said biasing means disposed within said biasing housing preventing said biasing means from exposure to said drilling fluid, and wherein when said valve apparatus is in a closed position the flow of a hydrocarbon well reservoir fluid in a second direction causes said biasing means to bias the ball member into engagement with the valve seat.

2. The apparatus of claim 1, wherein the biasing means is a spring.

3. The apparatus of claim 2 further comprising:

a ball stop scat formed on said biasing housing;

a passageway formed about the ball member when the flow of said drilling fluid is in the first direction, and wherein said drilling fluid flows on an outer portion of the biasing housing.

4. The apparatus of claim 3, further comprising:

a bleed off vent passage positioned within the seat housing for communicating a pressure upstream of the ball member with a pressure downstream of the ball.

5. The apparatus of claim 4, wherein said apparatus is attached to a work string, and wherein said work string is disposed within said hydrocarbon well bore.

6. The apparatus of claim 5, wherein the work string is connected to a bit means for drilling the hydrocarbon well bore.

7. A method for drilling a hydrocarbon well bore comprising:

providing a work string within the hydrocarbon well bore, the work string having a bit;

providing a valve device within the work string, said valve device comprising:

a base having a plurality of arms extending from the base; a seat housing abutting said plurality of arms and wherein said seat housing and said plurality of arms defines a cage; a ball member positioned within said cage; a spring member for biasing said ball member into engagement with a valve seat; a cylindrical biasing housing disposed within said base, wherein the flow of a drilling fluid in a first direction compresses the spring member so that flow of said drilling fluid proceeds through the valve device with said spring member disposed within said biasing housing preventing said spring member from exposure to said drilling fluid; and wherein the flow of a hydrocarbon well reservoir fluid in a second direction causes said spring member to bias the ball member into engagement with the valve seat;

flowing said drilling fluid in the first direction through the work string, said flow of said drilling fluid in said first direction opens said valve device by causing said ball member to unseat from the valve seat so that a passageway is formed about the ball member and said spring member to collapse within said cylindrical biasing housing preventing said spring member from exposure to said drilling fluid;

directing said drilling fluid about the biasing housing; and drilling the well bore with the bit.

8. The method of claim 7, wherein said hydrocarbon well reservoir fluid is a gas. the method further comprising:

drilling through a subterranean reservoir containing hydrocarbons;

migrating said gas from the reservoir into the hydrocarbon well bore;

flowing the gas in the second direction, said flow of gas in said second direction closing said valve device by causing said spring member to bias said ball member into engagement said valve seat terminating drilling with the bit.

9. The method of claim 8, wherein said valve device further comprises a bleed off vent passage and the method further comprises communicating a pressure upstream of the ball member with the pressure downstream of the ball member.

10. The method of claim 8, further comprising:

pumping a weighted fluid into an internal portion of the work string;

compressing the spring member;

disengaging the ball member from the valve seat;

pumping the weighted fluid through the bit and into the hydrocarbon well bore;

controlling the migration of the gas into the hydrocarbon well bore.

11. The method of claim 10, further comprising:

resuming the drilling with the bit.

12. A valve apparatus for controlling the flow of a medium in a hydrocarbon well bore comprising:

a base having a plurality of arms extending from the base;

a seat housing abutting said plurality of arms, wherein said base and said plurality of arms defines a cage, and wherein said seat housing includes a valve seat arid wherein a flow path is defined through said cage;

a ball member positioned within said cage arid wherein said ball member is moveable within said cage;

a spring for biasing said ball member into engagement with said valve seat;

a cylindrical biasing housing disposed within said base, and wherein said spring is disposed within said cylindrical biasing housing when said spring is compressed;

a passageway formed about the valve apparatus when the flow of a drilling fluid is in a first direction, and wherein said drilling fluid flows on an outer portion of the cylindrical biasing housing;

wherein when said valve a apparatus is in a closed position the flow of a hydrocarbon well reservoir fluid in a second direction causes said spring to bias the ball member into engagement with the valve seat, and wherein when said valve apparatus is in an opened position the flow of said drilling fluid in the first direction compresses and disposes the spring within said cylindrical biasing housing so that flow of said drilling fluid proceeds through the apparatus with said ball member blocking the flow of said drilling fluid from entering the cylindrical biasing housing and flowing through said spring.

13. The apparatus of claim 12, wherein the seat housing contains a vent opening.

14. The apparatus of claim 12, further comprising a spring guide having said spring disposed thereon; and a ball stop seat formed on said cylindrical biasing housing.

15. The apparatus of claim 14 further comprising:

a bleed off vent passage positioned within the seat housing for communicating a pressure upstream of the ball member with a pressure downstream of the ball member.

16. The apparatus of claim 15, wherein said apparatus is located within a work sting within said hydrocarbon well bore.

17. The apparatus of claim 15, wherein said apparatus is located at the surface of a drilling rig and operatively associated with a Kelly.

18. A valve apparatus for controlling the flow of a medium in a hydrocarbon well comprising:

a base having a plurality of arms extending from the base;

a seat housing abutting said plurality of arms, wherein said base and said plurality of arms defines a cage, and wherein said seat housing includes a valve seat;

a ball valve positioned within said cage;

a spring housing disposed within said base and attached to said plurality of arms;

a passageway formed about the ball valve when the flow of a drilling fluid is in a first direction, and wherein said drilling fluid flows through an inner bore of the seat housing;

a bleed off vent passage positioned within the seat housing for communicating a pressure upstream of the ball member with a pressure downstream of the ball member;

a spring for urging the ball valve into engagement with said valve seat;

a spring guide disposed within said spring, and wherein said spring and spring guide are partially disposed within said spring housing;

a cradle attached to said spring guide, said cradle having a concave surface engaging said ball member;

wherein when said valve apparatus is in a closed position the flow of a hydrocarbon well reservoir fluid in a second direction causes said spring to bias.

* * * * *

UNITED STATES PATENT AND TRADEMARK OFFICE

CERTIFICATE OF CORRECTION

PATENT NO. : 7,604,063 B2
APPLICATION NO. : 11/054763
DATED : October 20, 2009
INVENTOR(S) : Benny Donald Mashburn It is certified that error appears in the above-identified patent and that said Letters Patent is hereby corrected as shown below:

Column 6, line 33, change "said valve a apparatus" to -- said valve apparatus --;

Column 6, line 36, change "through apparatus said valve apparatus" to -- through said valve apparatus --;

Column 7, line 35, change "engagement said valve seat" to -- engagement with said valve seat; and --;

Column 7, line 57, change "a valve seat arid" to -- a valve seat and --;

Column 7, line 59, change "said cage arid wherein" to -- said cage and wherein --;

Column 8, line 8, change "said valve a apparatus" to -- said valve apparatus --;

Column 8, line 60, change "bias." to -- bias the ball valve into engagement with the valve seat, and wherein when the valve apparatus is in an opened position the flow of said drilling fluid in the first direction disengages the ball valve from the valve seat and completely disposes said spring within said spring housing so that flow of said drilling fluid proceeds through said valve apparatus with said ball valve blocking the flow of said drilling fluid from entering the spring housing and contacting said spring. --.

Signed and Sealed this

Sixteenth Day of February, 2010

David J. Kappos

David J. Kappos
*Director of the United States Patent and Trademark Office*